US005922273A

United States Patent [19]

Knecht et al.

[11] Patent Number: 5,922,273

[45] Date of Patent: Jul. 13, 1999

[54] MODULAR HEARTH ARRANGEMENT FOR COLD HEARTH REFINING

[75] Inventors: Joseph A. Knecht, Denver; Dana C. King, Pennsburg; Richard R. Roth, Birdsboro; Alan E. Blackburn, Reading, all of Pa.

[73] Assignee: Titanium Hearth Technologies, Inc., Morgantown, Pa.

[21] Appl. No.: 08/923,203

[22] Filed: Sep. 4, 1997

[51] Int. Cl.[6] ..... C21B 7/12

[52] U.S. Cl. ..... 266/46; 266/202; 266/208; 266/241

[58] Field of Search ..... 266/241, 201, 266/202, 208, 46

[56] References Cited

U.S. PATENT DOCUMENTS 2,825,641 3/1958 Beall et al. ..... 266/208

2,858,586 11/1958 Brennan ..... 266/208

2,935,395 5/1960 Smith, Jr. ..... 266/208

5,516,081 5/1996 Mourer ..... 266/241

*Primary Examiner*—Scott Kastler

*Attorney, Agent, or Firm*—Baker & Botts L.L.P.

[57] ABSTRACT

In the particular embodiment described in the specification, a cold hearth arrangement has a hearth plate forming a floor above the bottom of a melt chamber enclosure and a hearth is removably mounted on the hearth plate. Coolant supply and return lines are connected through the hearth support plate to the bottom of the hearth so that no utility lines are exposed above the floor plate. A mold, which also has water supply and return lines connected to it beneath the floor plate extends through the bottom of the enclosure.

6 Claims, 2 Drawing Sheets

MODULAR HEARTH ARRANGEMENT FOR COLD HEARTH REFINING

BACKGROUND OF THE INVENTION

This invention relates to hearth arrangements for cold hearth refining.

Cold hearth refining of materials such as metal alloys is normally carried out in an evacuated melt chamber in which a hearth is mounted in position to receive the material to be refined and to supply molten refined material to an outlet arrangement such as an ingot mold. The hearth, which is conventionally supported on an open base arrangement receives energy to melt the material to be refined from electron beam or plasma sources near the top of the evacuated melt chamber. To cool the walls of the hearth, the hearth contains internal water ducts and water supply and return lines are connected from the side wall of the evacuated chamber to the side of the hearth.

Such conventional arrangements expose the water circulation pipes to potential damage from electron beam or plasma arc energy sources intended to be directed toward the material in the hearth and to mechanical damage from moving of objects within the melt chamber during set up and shut down. They also allow accumulation of loose raw material on the floor of the chamber adjacent to and beneath the hearth which must be removed in order to maintain a clean melt chamber.

SUMMARY OF THE INVENTION

Accordingly it is an object of the present invention to provide a hearth arrangement for cold hearth refining which overcomes the disadvantages of the prior art.

Another object of the invention is to provide a hearth arrangement for cold hearth refining which allows convenient preparation of the melt chamber for refining operations.

These and other objects of the invention are attained by providing a removable floor plate in a melt chamber which is arranged to cover the lower part of the chamber, a hearth affixed to the floor plate, and coolant supply lines for supplying coolant to the hearth which pass through the floor plate to the bottom of the hearth. To facilitate access to the coolant supply lines an access port is provided in the bottom of the melt chamber. Preferably, the hearth is removably affixed to the floor plate to facilitate assembly and disassembly.

BRIEF DESCRIPTION OF THE DRAWINGS

Further objects and advantages of the invention will be apparent from a reading of the following description in conjunction with the accompanying drawings in which.

DESCRIPTION OF PREFERRED EMBODIMENT

Figure 1:
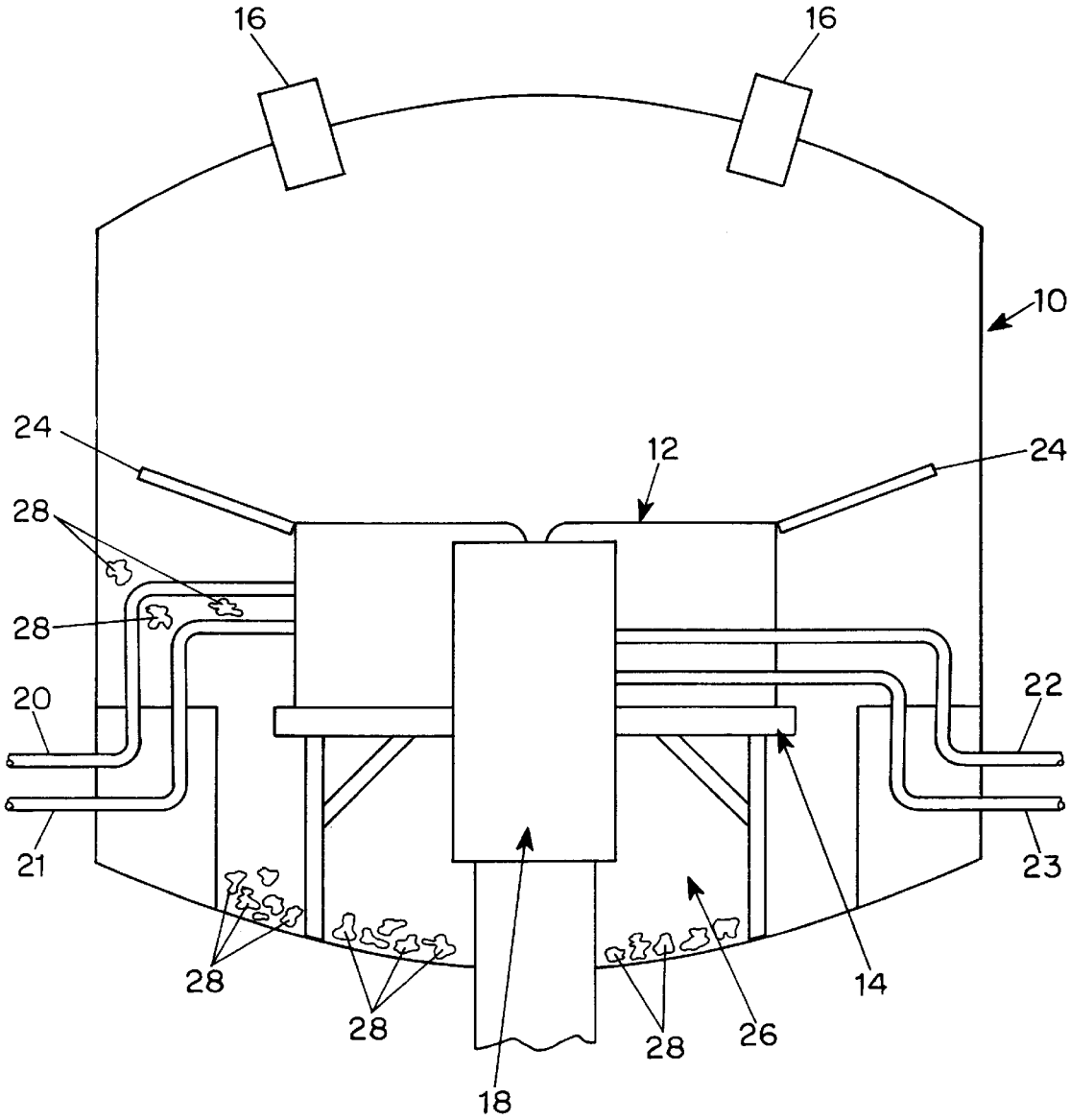
FIG. 1 PRIOR ART
FIG. 1 is a schematic sectional view illustrating a typical melt chamber for cold hearth refining arranged in accordance with the prior art.

Referring first to the prior art arrangement shown in FIG. 1, a melt chamber 10 for cold hearth refining which is a vacuum enclosure contains a hearth 12 supported on an open base 14 and disposed beneath energy sources 16 such as electron beam or plasma guns by which energy can be directed to metal alloys and the like contained within the hearth 12 to melt and refine the alloy material. After refining, the molten metal is conveyed to a water-cooled vertical mold 18 mounted at the discharge of the hearth, in which the molten metal is solidified to form an ingot.

In order to cool the hearth 12, a coolant such as cold water, circulated through a supply line 20 and a return line 21, passes through internal ducts in the hearth 12. The mold 18 is also cooled by circulation of water through a supply line 22 and a return line 23 mold 18. As shown in FIG. 1, the water circulation lines 20 and 22 enter the melt chamber at an access point on one side and extend horizontally toward the side of the hearth and the mold so that they are exposed to possible damage from stray electron or plasma energy from the sources 16 and to mechanical damage from objects being moved within the melt chamber during setup and shut down operations. In order to protect the water lines 20-23 from energy beams, movable protection plates 24 are often provided over the regions through which the lines extend to the hearth and the mold.

Furthermore, the conventional hearth arrangement has a space 26 beneath the hearth support base in which loose pieces of 28 of alloy or other material to be processed can collect. To avoid contamination of material being processed, such loose material should be removed after each operation of the hearth which requires careful cleaning of the bottom of the melt chamber.

Thus, the conventional cold hearth design is not only a complex combination of multiple pieces used to make up the hearth but also involves exposed utility lines such as coolant supply and return lines which are subject to damage, and involves extensive cleaning operations.

Figure 2:
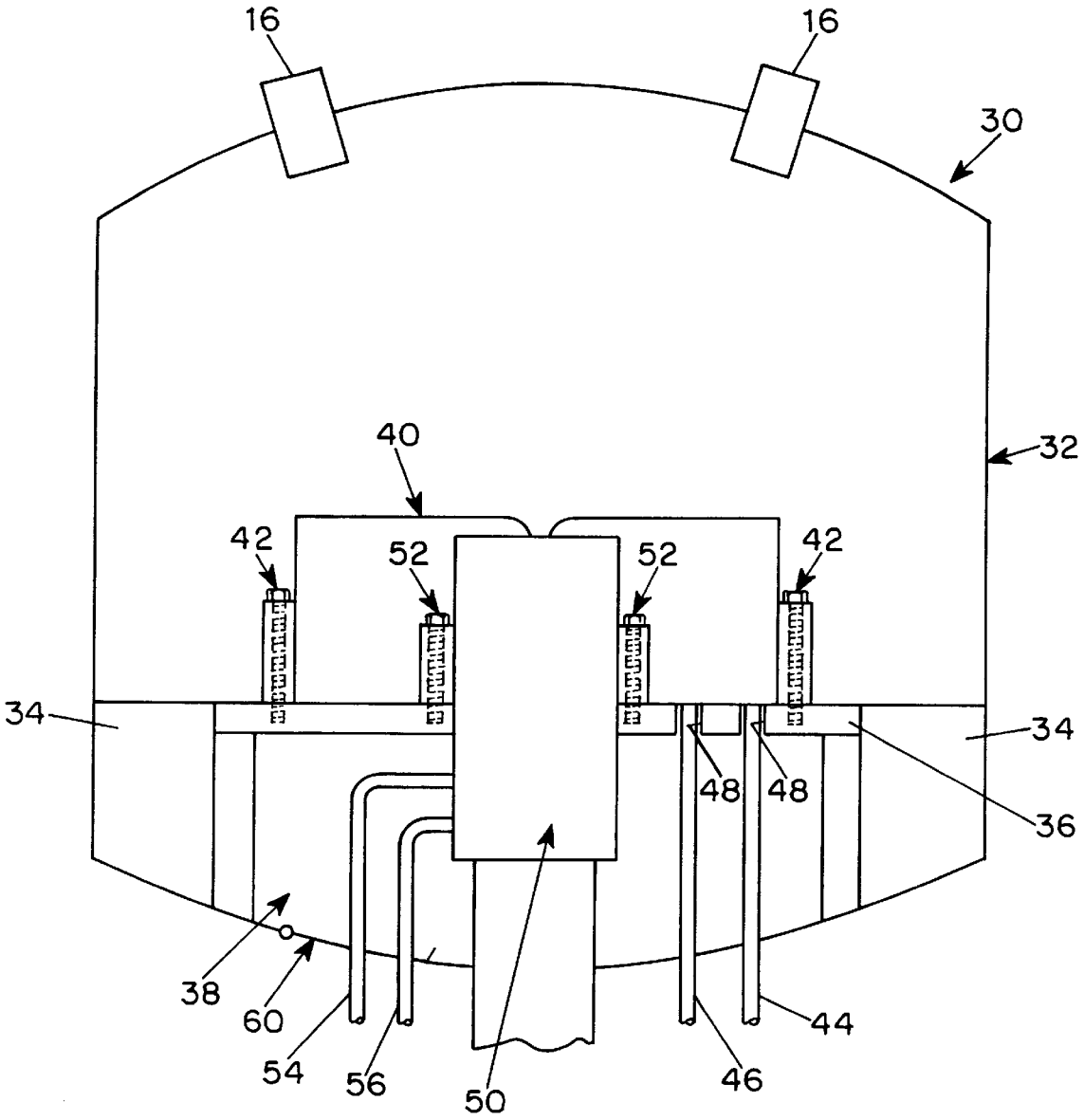
FIG. 2 is a representative embodiment of a cold hearth refining arrangement in accordance with the invention.

In accordance with the invention, these problems are avoided by providing a modular hearth arrangement 30 of the type shown in FIG. 2. In this arrangement, a melt chamber 32 has platform parts 34 around its periphery which are arranged to receive a hearth plate 36 in closely fitting engagement so as to provide a false floor covering a space 38 at the bottom of the melt chamber, the edges of the plate 36 being in engagement with the platforms 34 so as to preclude loose material from passing below the false floor. A cold hearth 40 is mounted by bolts 42 on the floor plate 36 and coolant supply and return lines 44 and 46 are connected through openings 48 in the removable floor plate 36 to the bottom of the hearth 40 where they supply coolant to the internal coolant circulation ducts. Similarly, a mold 50, which receives molten metal from the hearth and extends toward the bottom of the melt chamber has coolant supply and return lines 54 and 56 connected to it beneath the plate 36. In order to facilitate access to the region 38 below the floor plate 36, an access port 60 is provided at a location that is convenient to all water line connections.

With this arrangement no utility lines to the hearth 40 or the mold 50 are exposed above the floor plate 36, thereby preventing damage not only from the energy from the electron beam or plasma guns directed toward the hearth but also from objects being moved around the hearth during set-up operations. Furthermore, any loose material falling on the floor plate 36 during operation cannot pass to the space 38 and thus is easily removed from the chamber.

Moreover, the hearth arrangement may be readily assembled and disassembled by removal of the bolts 42 and 52 and separate removal of the hearth 40, the mold 50 and the floor plate 36 after the water lines 44, 46, 54 and 56 have been disconnected.

Although the invention has been described herein with reference to specific embodiments, many modifications and variations therein will readily occur to those skilled in the art. Accordingly, all such variations and modifications are included within the intended scope of the invention.

I claim:

1. A cold hearth arrangement comprising:

an enclosure in which energy from an energy source may be directed toward material to be melted in a hearth;

a floor plate providing a floor above the bottom of the enclosures in close fitting relation with side portions of the enclosure;

a cold hearth having a peripheral surface surrounded by and extending above the floor plate; and coolant lines extending through the space beneath the floor plate and passing through the floor plate into the bottom of the hearth.

2. A cold hearth arrangement comprising:

an enclosure in which energy from an energy source may be directed toward material to be melted in a hearth;

a floor plate providing a floor above the bottom of the enclosures in close fitting relation with side portions of the enclosure;

a cold hearth having a peripheral surface surrounded by and extending above the floor plate; and coolant lines extending through the space beneath the floor plate and passing through the floor plate into the bottom of the hearth;

wherein the hearth is removably affixed to the floor plate.

3. A cold hearth arrangement according to claim 1 including an access opening in a portion of the enclosure beneath the floor plate permitting access to the coolant lines.

4. A cold hearth arrangement according to claim 1 including a mold extending through the floor plate and the bottom of the enclosure and positioned to receive molten material from the hearth.

5. A cold hearth arrangement according to claim 4 including coolant supply lines for supplying coolant to the mold at a location beneath the floor plate.

6. A method for making a cold hearth refining arrangement comprising:

mounting a floor plate above the bottom of a vacuum enclosure;

mounting a hearth having internal coolant ducts on the floor plate; and connecting coolant lines through the floor plate to the bottom of the hearth.

* * * * *

UNITED STATES PATENT AND TRADEMARK OFFICE

CERTIFICATE OF CORRECTION

PATENT NO. : 5,922,273

DATED : July 13, 1999

INVENTOR(S) : Richard J. Roth

It is certified that error appears in the above-identified patent and that said Letters Patent is hereby corrected as shown below:

On the title page item [75] Inventors: "Richard R. Roth," should read -- Richard J. Roth, --.

Signed and Sealed this

Seventeenth Day of October, 2000

*Attest:*

Q. TODD DICKINSON

*Attesting Officer*

*Director of Patents and Trademarks*